US008974607B2

(12) United States Patent
Al-Otaibi

(10) Patent No.: US 8,974,607 B2
(45) Date of Patent: Mar. 10, 2015

(54) CLEANING APPARATUS FOR HEAT EXCHANGE TUBES OF AIR COOLED HEAT EXCHANGERS

(71) Applicant: Saudi Arabian Oil Company, Dhahran (SA)

(72) Inventor: Abdullah M. Al-Otaibi, Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 112 days.

(21) Appl. No.: 13/726,452

(22) Filed: Dec. 24, 2012

(65) Prior Publication Data

US 2013/0312794 A1 Nov. 28, 2013

Related U.S. Application Data

(60) Provisional application No. 61/580,821, filed on Dec. 28, 2011.

(51) Int. Cl.
*B08B 3/00* (2006.01)
*F28G 1/16* (2006.01)

(52) U.S. Cl.
CPC ..... *F28G 1/166* (2013.01)
USPC ..... 134/166 R

(58) Field of Classification Search
CPC ..... B08B 9/093
See application file for complete search history.

(56) References Cited

U.S. PATENT DOCUMENTS

| | | | | |
|---|---|---|---|---|
| 2,112,896 | A | | 4/1938 | Husband |
| 3,806,040 | A | | 4/1974 | McCloy, Sr. |
| 3,980,120 | A | | 9/1976 | Fawcett et al. |
| 4,424,769 | A | | 1/1984 | Charamathieu et al. |
| 4,827,953 | A | | 5/1989 | Lee |
| 4,982,959 | A | | 1/1991 | Rudell et al. |
| 5,065,703 | A | | 11/1991 | Lee |
| 5,330,579 | A | | 7/1994 | Rushing et al. |
| 5,411,043 | A | | 5/1995 | Kamler |
| 5,672,123 | A | * | 9/1997 | Rudell et al. ..... 473/414 |
| RE38,542 | E | | 7/2004 | Ashton et al. |
| 6,820,575 | B2 | | 11/2004 | Ashton, III et al. |

FOREIGN PATENT DOCUMENTS

| | | |
|---|---|---|
| DE | G 94-18-733.9 | 1/1995 |
| WO | WO 2004/079286 | 9/2004 |
| WO | WO 2009/088484 | 7/2009 |

* cited by examiner

*Primary Examiner* — Jason Ko
(74) *Attorney, Agent, or Firm* — Abelman, Frayne & Schwab

(57) ABSTRACT

An apparatus, operable with a source of cleaning fluid under pressure, for cleaning external surfaces of heat exchange tubes of an air cooled heat exchanger which tubes are situated in generally horizontal rows vertically separated from each other, thus defining a generally horizontal zone between each two adjacent rows, including a. a spray mat having:
   i. top and bottom fluid impermeable sheets sealed at their mutual peripheral edges defining at least one chamber with a fluid inlet into said chamber for receiving a flow of the cleaning fluid under pressure, and
   ii. a plurality of laterally spaced apertures and coupled spray nozzles in the top and bottom sheets which are in fluid communication with the chamber, and b. a positioning mechanism for moving the spray mat transversely into and out of one of the zones between two adjacent rows of the heat exchange tubes.

17 Claims, 11 Drawing Sheets

CLEANING APPARATUS FOR HEAT EXCHANGE TUBES OF AIR COOLED HEAT EXCHANGERS

I. CROSS REFERENCES TO RELATED CASES

Figure 1:
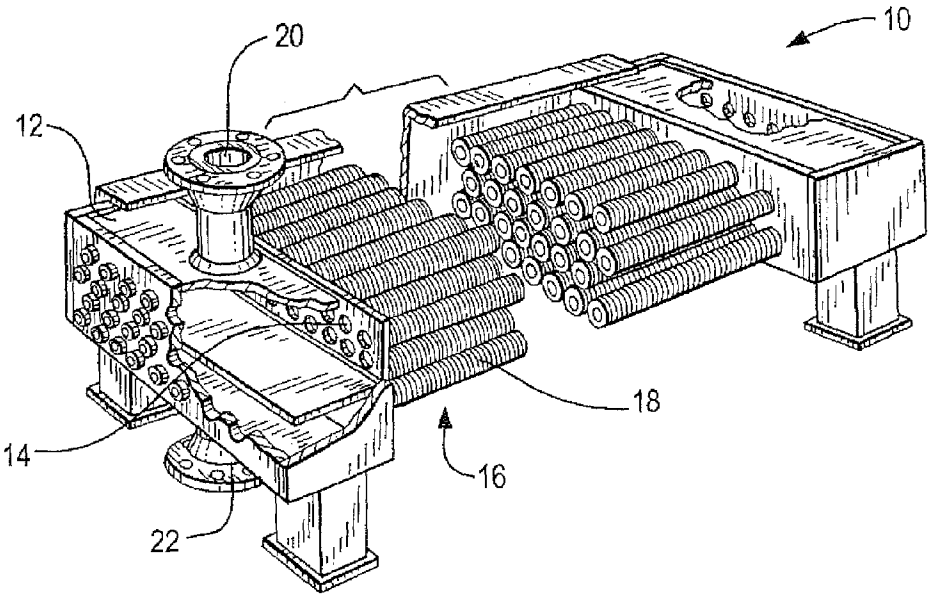

This is a non-provisional application claiming priority under 35 USC §119, 120 and/or 365 on provisional application Ser. No. 61/580,821 filed Dec. 28, 2011, a copy of which is incorporated herein by reference.

II. FIELD OF THE INVENTION

This invention is in the field of air cooled heat exchangers and particularly methods and apparatus for cleaning the outer surfaces of bundles of heat exchange tubes of air cooled or other heat exchangers.

III. BACKGROUND AND PRIOR ART

In certain large scale facilities for production, treatment, storage and distribution of gas and liquid products there are a large number of conventional air cooled heat exchangers. These facilities sometimes experience substantially excessive high power consumption and low performance due to fouling accumulation on external surfaces of cooling fins as heat exchange tubes. This is particularly true in an environment like that of Saudi Arabia where the air is filled with heavy dust so that tube bundles of air cooled heat exchangers become externally plugged in a short period of time and require frequent and extensive cleaning. Existing cleaning methods are known to be both expensive and not fully successful because of heat exchanger construction where many tubes with their closely spaced fins are packed in relatively tight bundles. Many surfaces are not reached by the cleaning liquid or spray since many are below or otherwise blocked by others closer to the source of the cleaning spray. The same problem exists even with mechanical brushing or scraping, as there are such a great many areas that are simply not accessible.

In applicant's various facilities there are together more than 15,000 air cooled heat exchangers that are regularly fouled and require frequent and repeated cleaning. The estimated cleaning cost by a company-wide survey was $12 million annually, without even considering other costs from slowdown or (operation bottlenecking) or other process interruptions. The above-noted cost does not include other mechanical damage caused by conventional types of cleaning to the fins and heat exchange tubes.

The present invention seeks to provide a new and improved apparatus and method for cleaning the external surfaces of finned tubes of air cooled heat exchangers.

IV. OBJECTS AND SUMMARY OF THE INVENTION

A first object is to provide a new apparatus and method for cleaning the external surfaces of heat exchange tubes in air cooled heat exchangers which provides more effective cleaning and without additional power consumption and with less damage to the cooling fins and heat exchange tubes.

Another object is to provide a method and apparatus where the cleaning spray heads are carried by a central body and moved laterally between layers of tubes and/or moved axially along the tubes between said layers, to position the spray heads in the closest possible proximity to the outer surfaces of the heat exchange tubes.

A further object of the invention is to provide a great plurality of spray heads carried by a laminate sheet that is movable between layers of tubes of the tube bundles and to thereby spray large areas simultaneously with spray directed at short range onto the external surfaces.

A still further object of the invention is to provide a structure to hold and transport the great many spray nozzles, the structure being in the form of a sheet which is movable axially or transversely of the space above a top layer or between adjacent layers of tubes.

It is a still further object for the nozzle carrying element to have an air mattress type structure comprising upper and lower sheets welded together in designated areas to define liquid flow passages from a fluid inlet to the multiple outlet spray nozzles.

An additional object is to provide a transport mechanism for moving a sheet as described above, in said transverse and axial directions for cleaning, and to subsequently fully remove such sheet from the area adjacent said tubes.

An additional object is to provide rollers and drive means for rolling up said sheet in an area external of the tube bundle when the sheet is not in use, and later for facilitating delivery of the sheet to the areas above or between rows of tubes.

A still further object is to provide in said sheet, outlet nozzles which will pop out externally of the sheet surface under the influence of cleaning fluid pressure being directed through said sheet and to said nozzles, for the purpose of moving the nozzles outward of the sheet surface and closer to the surface areas being cleaned.

Another object is to provide a spring element in the above-described nozzles biasing them to their retracted position when they are not being urged by the fluid pressure, so that the sheet with its retracted nozzles will be as thin as possible for maneuvering into the spaces between rows and layers of said tubes. With the above type of new structure and method, the sheet with its outlet nozzles can be rolled up for storage or can be unrolled and slid into the narrow spaces between layers of tubes of the tube bundle.

A still further object is to provide a secondary sheet generally parallel to and spaced below the primary spray sheet and movable essentially at the same time in the same way as the spray sheet, but positioned below the row of tubes being spray cleaned. Thus, if the spray sheet is above the top row, the collection sheet would be below the top row. If the spray sheet is between the top row and the second row down, the collection sheet would be between the second and third rows. In this manner the purpose of the collection sheet is to collect the soiled water and cleaned-off fouling substances from the row of tubes cleaned, and to drain same off to an external area, so that it does not drip down and further foul the heat exchange tubes below the ones that have been cleaned. The collection sheet is also called the sink while the spray sheet is also called the source. Alternately, the collection sheet may e positioned to collection drainage independently of movement of the spray sheet. Some examples of embodiments of the present invention are described below.

A first embodiment exemplified by an apparatus, operable with a source of cleaning fluid under pressure, for cleaning external surfaces of heat exchange tubes of an air cooled heat exchanger which tubes are situated in generally horizontal rows that are vertically separated from each other, thus defining a generally horizontal zone between each two adjacent rows, which space has a height defined by the distance between each of said two adjacent rows, comprising:

a. a spray mat having:

i. top and bottom fluid impermeable sheets sealed at their mutual peripheral edges defining at least one chamber between said sheets, with at least one fluid inlet into said chamber for receiving a flow of said cleaning fluid under pressure, ii. a plurality of laterally spaced apart apertures in at least one of said top and bottom sheets, said apertures being in fluid communication with said at least one chamber, and iii. a spray nozzle coupled to each of said apertures for outward spraying of cleaning fluid received from said chamber, and b. a positioning mechanism for moving said spray mat transversely into one of said zones between two adjacent rows of said heat exchange tubes, where said cleaning fluid can be sprayed onto the external surfaces of said heat exchanger tubes in said zone, and for moving said spray mat out of said zone.

A second embodiment according to said first embodiment which has said plurality of spaced apart apertures in both said top and bottom sheets.

A third embodiment according to said first embodiment where said top and bottom sheets have mutually facing inside surfaces that are sealed together at predetermined locations to define:

a. said chamber and b. a plurality of fluid flow channels communicating said inlet with said plurality of outlet apertures.

A fourth embodiment according to said second embodiment where said top and bottom sheets are formed of plastic and are heat sealed together at their peripheral edges and at other areas for defining said flow channels within said chamber between said sheets.

A fifth embodiment according to said first embodiment where said positioning mechanism is adapted to move said spray mat to selected elevations for positioning said spray mat into different ones of said zones.

A sixth embodiment according to said fifth embodiment where said positioning mechanism includes a roller onto which said spray mat is rolled and stored until said spray mat is unrolled and inserted into one of said zones.

A seventh embodiment according to said first embodiment where each of said spray nozzles has an outer surface and has a retracted position where its outer surface is generally close to the external surface of said top or bottom sheet where it is situated, and has an extended position extending outwardly from the plane of said surface, further comprising a spring biasing said spray nozzle to its retracted position, said nozzle being pushed to its extended position when cleaning fluid under pressure is flowed from said source of cleaning fluid through said chamber to said nozzle.

An eighth embodiment according to said seventh embodiment where each of said springs has force F, and said cleaning fluid exerts a pressure greater than force F, which thereby pushes said spray nozzle to its extended position when said cleaning fluid is flossing under pressure to said spray nozzles.

A ninth embodiment according to said first embodiment further comprising a collection sheet having leading and trailing edges and a generally central area with a drain aperture therein, said positioning mechanism further including coupling for inserting said collection sheet into one of said zones below a zone where said spray mat has been inserted, and where said collection sheet receives cleaning fluid dripping down from said spray met and from external services of heat exchange tubes which received cleaning fluid from said spray mat, said cleaning fluid being discharged from said drain aperture in said collection sheet.

A tenth embodiment according to said ninth embodiment where said collection sheet comprises a frame maintaining it in a generally horizontal plane except for said central drainage aperture which is at a lower elevation.

An eleventh embodiment according to the ninth embodiment where said positioning mechanism positions both said spray mat and said collection sheet simultaneously into and out of each of said zones.

A twelfth embodiment according to said first embodiment where each of said spray nozzles distributes cleaning fluid in a flow pattern substantially greater than the inlet diameter of said spray nozzle.

A thirteenth embodiment according to said second embodiment where the height of said spray mat with said spray nozzles in their extended state is less than the height of said zone between two adjacent rows of said heat exchange tubes.

An embodiment exemplified by a method operable with a source of cleaning fluid under pressure, for cleaning external surfaces of heat exchange tubes of an air cooled heat exchanger which tubes are situated in generally horizontal rows that are vertically separated from each other, thus defining a generally horizontal zone between each two adjacent rows, which space has a height defined by the distance between each of said two adjacent rows, comprising:

a. providing a spray mat having:

i. top and bottom fluid impermeable sheets sealed at their mutual peripheral edges defining at least one chamber between said sheets, with at least one fluid inlet into said chamber for receiving a flow of said cleaning fluid under pressure, ii. a plurality of laterally spaced apart apertures in at least one of said top and bottom sheets, said apertures being in fluid communication with said at least one chamber, and iii. a spray nozzle coupled to each of said apertures for outward spraying of cleaning fluid received from said chamber, and b. positioning said spray mat transversely into one of said zones between two adjacent rows of said heat exchange tubes and spraying said outer surfaces of said heat exchange tubes in said zone with said cleaning fluid.

A further embodiment comprising the step of inserting a collection sheet onto one of said zones below a zone where a spray mat is inserted to collect cleaning fluid that drips downward from heat exchange tubes onto which it had been sprayed.

V. BRIEF DESCRIPTION OF THE DRAWINGS

FIGS. 1-10 illustrate a first embodiment of the new invention, and FIGS. 11-14 illustrate a second embodiment. For convenience and clarity similar components in the two embodiments have been given the same reference numbers.

Figure 2:
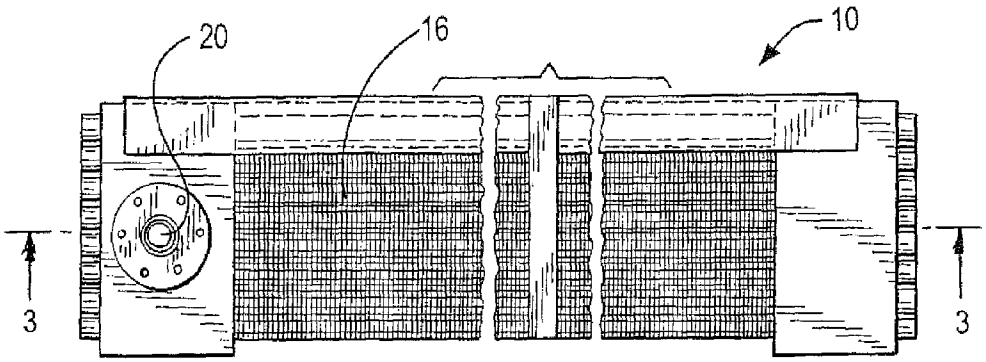
Figure 3:
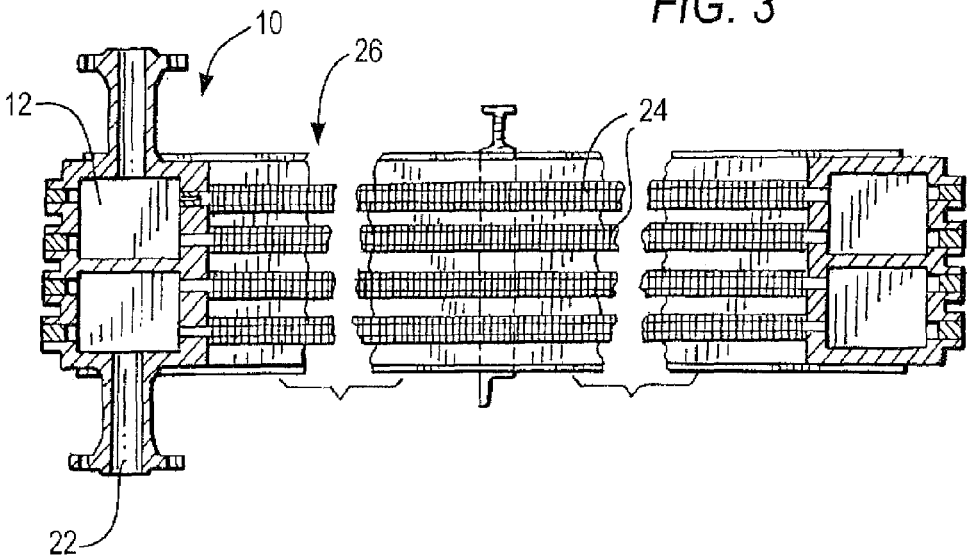
Figure 4:
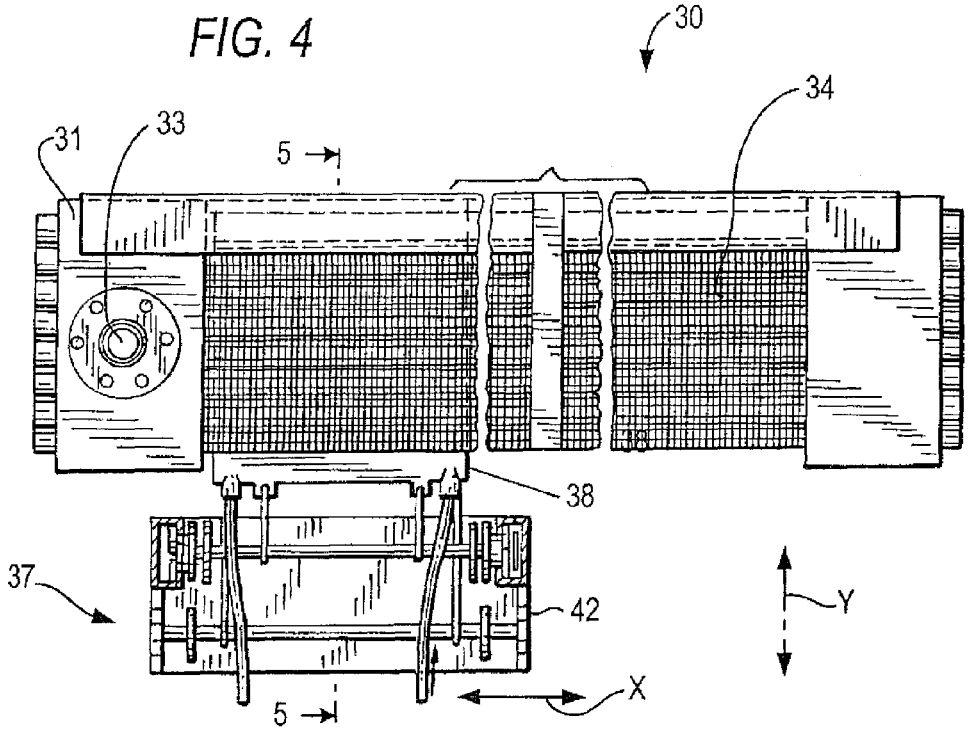
Figure 5:
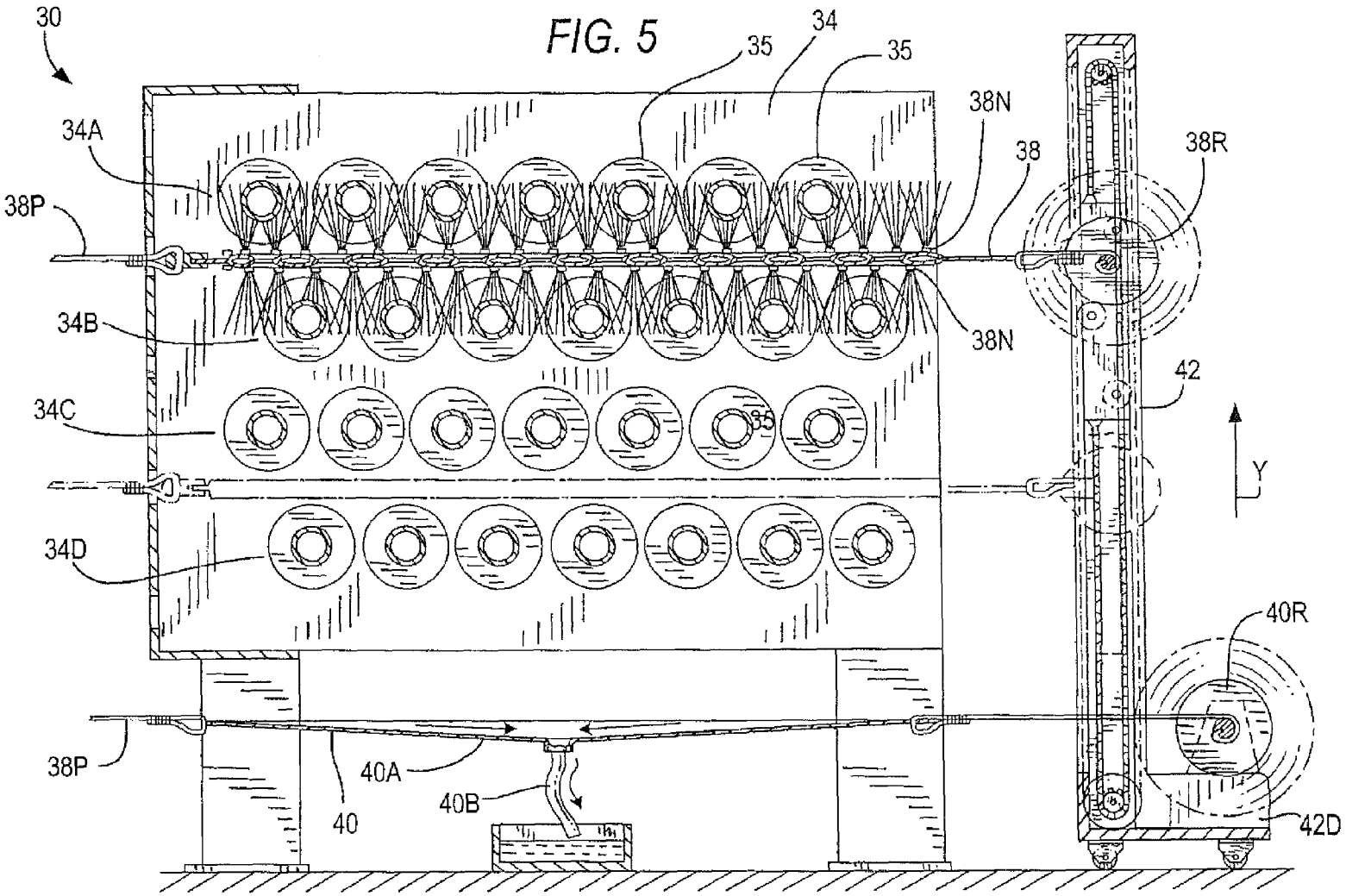
Figure 6:
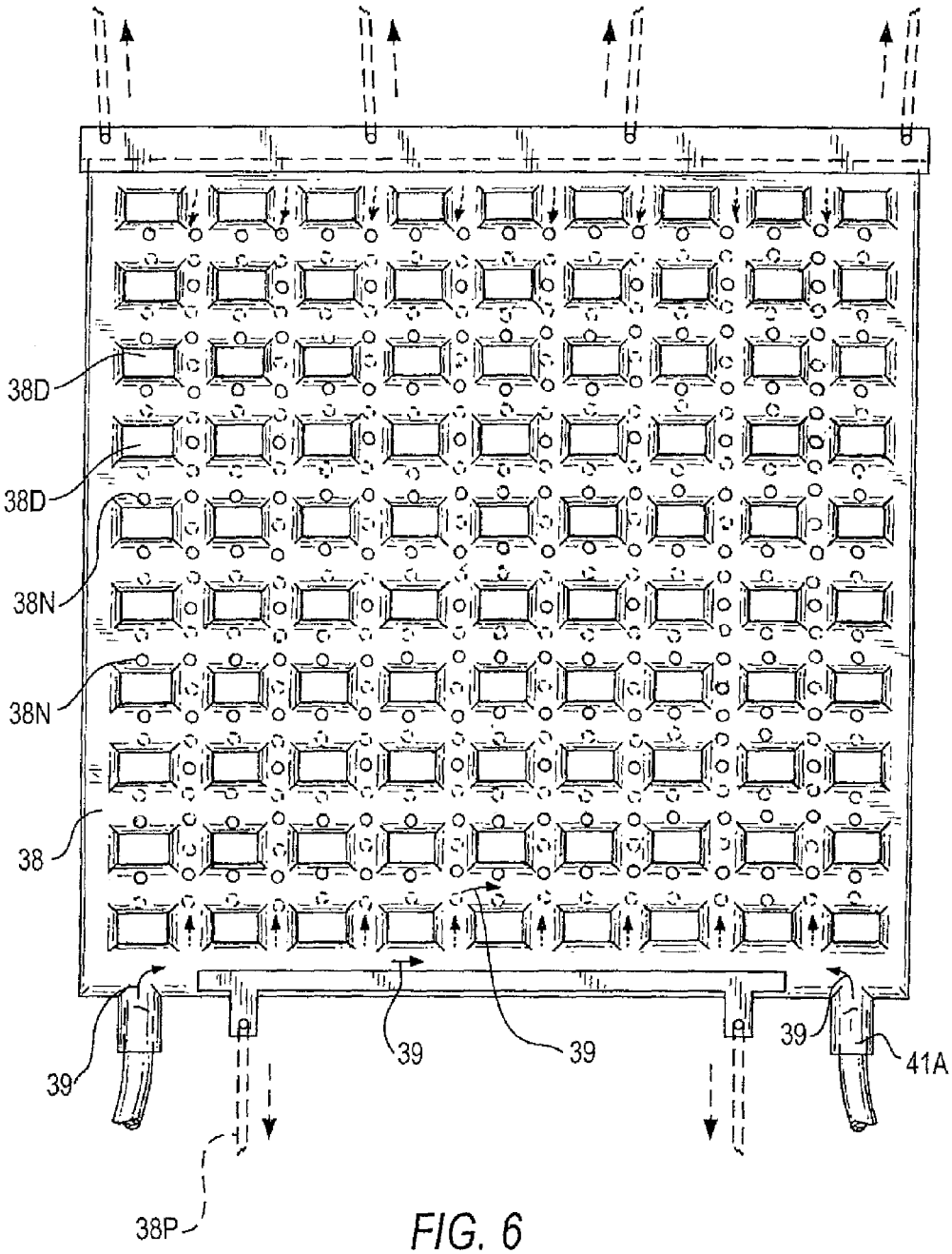
Figure 7:
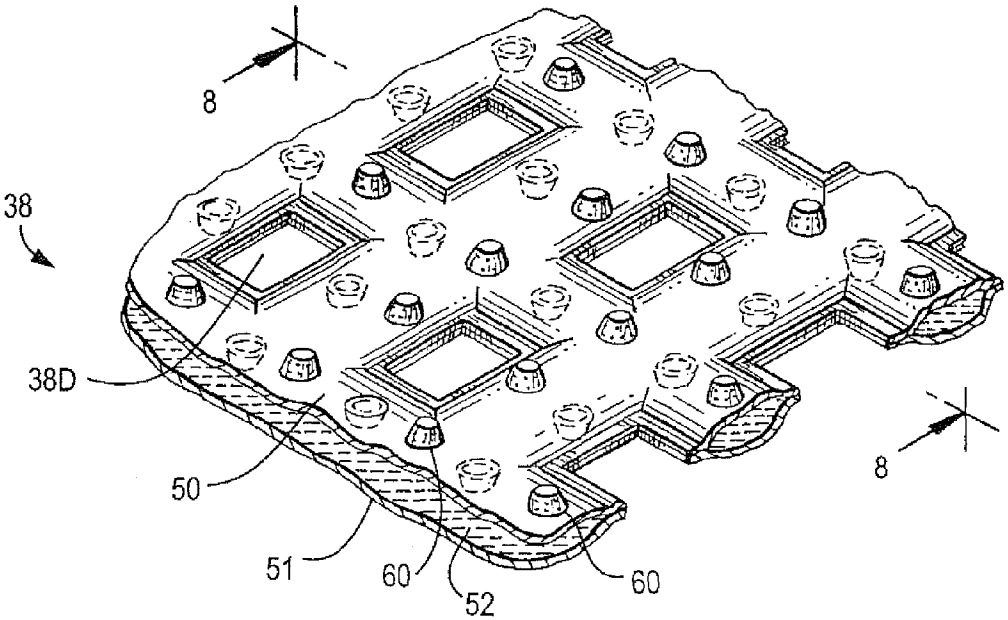
Figure 8:
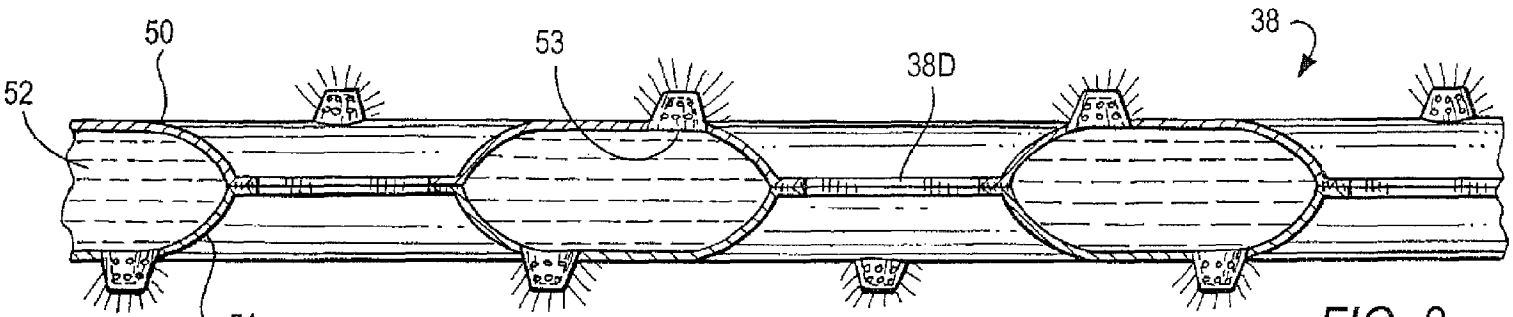
Figure 9A:
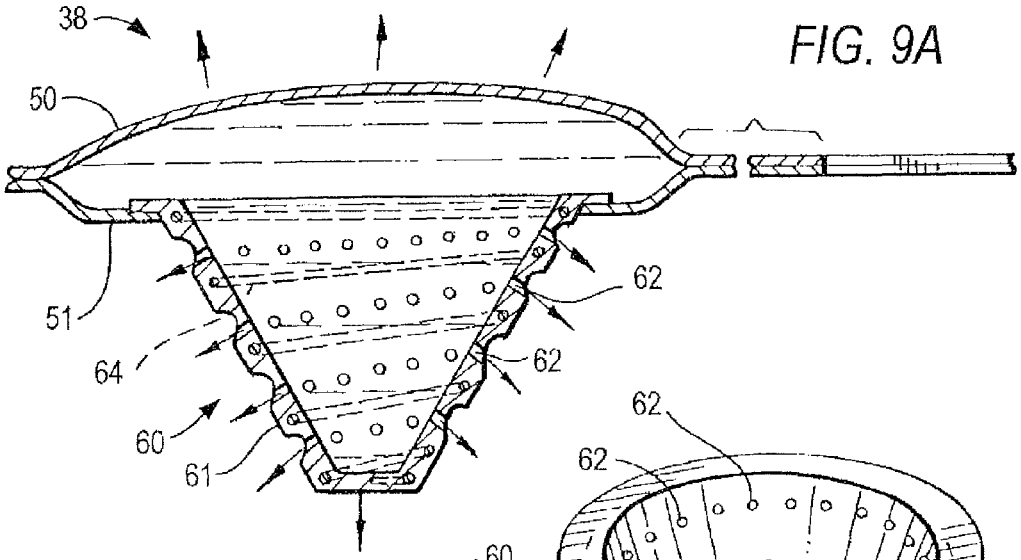
Figure 9B:
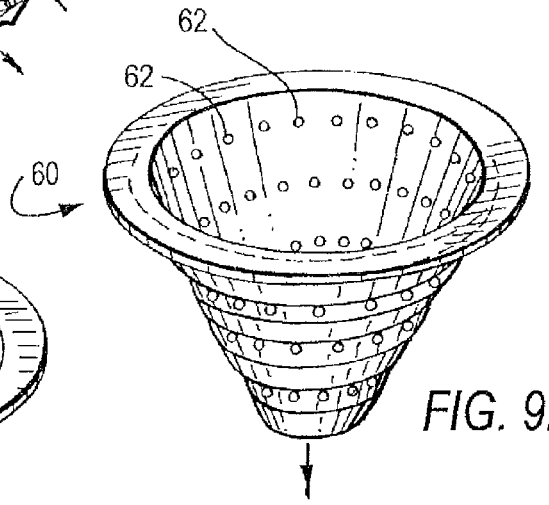
Figure 9C:
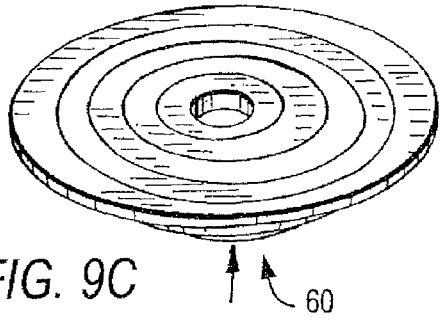

FIG. 1 is a front perspective exploded view partially cutaway of a prior art air cooled heat exchanger (ACHE), FIG. 2 is a top plan view of the heat exchanger of FIG. 1, FIG. 3 is an elevation view in section taken along line 3-3 in FIG. 2, FIG. 4 is a fragmentary top plan view of an ACHE with a first embodiment of the new cleaning apparatus of this invention, FIG. 5 is a sectional view taken along line 5-5 in FIG. 4 of the heat exchanger and cleaning apparatus of FIG. 4, FIG. 6 is a schematic top plan view of the spray pad of the new invention, FIG. 7 is a fragmentary top perspective view partially in section of the spray pad of FIG. 6, FIG. 8 is a fragmentary view partially in section taken along line 8-8 in FIG. 7, FIG. 9A is a fragmentary sectional view of the spray pad of FIG. 6 showing the spray nozzle, FIG. 9B is a top front perspective view of the spray nozzle of FIG. 9A, shown in its extended state, FIG. 9C is a top front perspective view of the spray nozzle of FIG. 9A, shown in its retreated state.

Figure 9E:
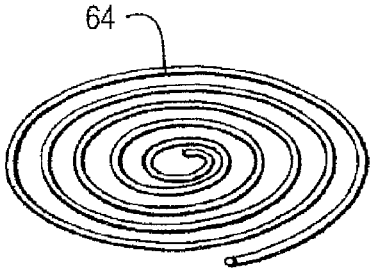
Figure 9D:
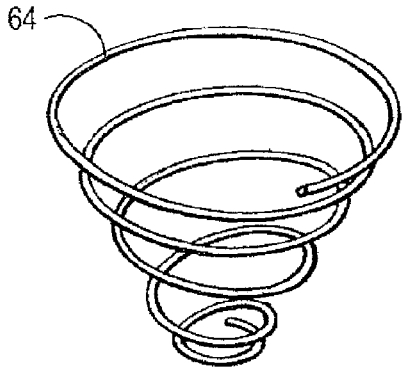
Figure 10:
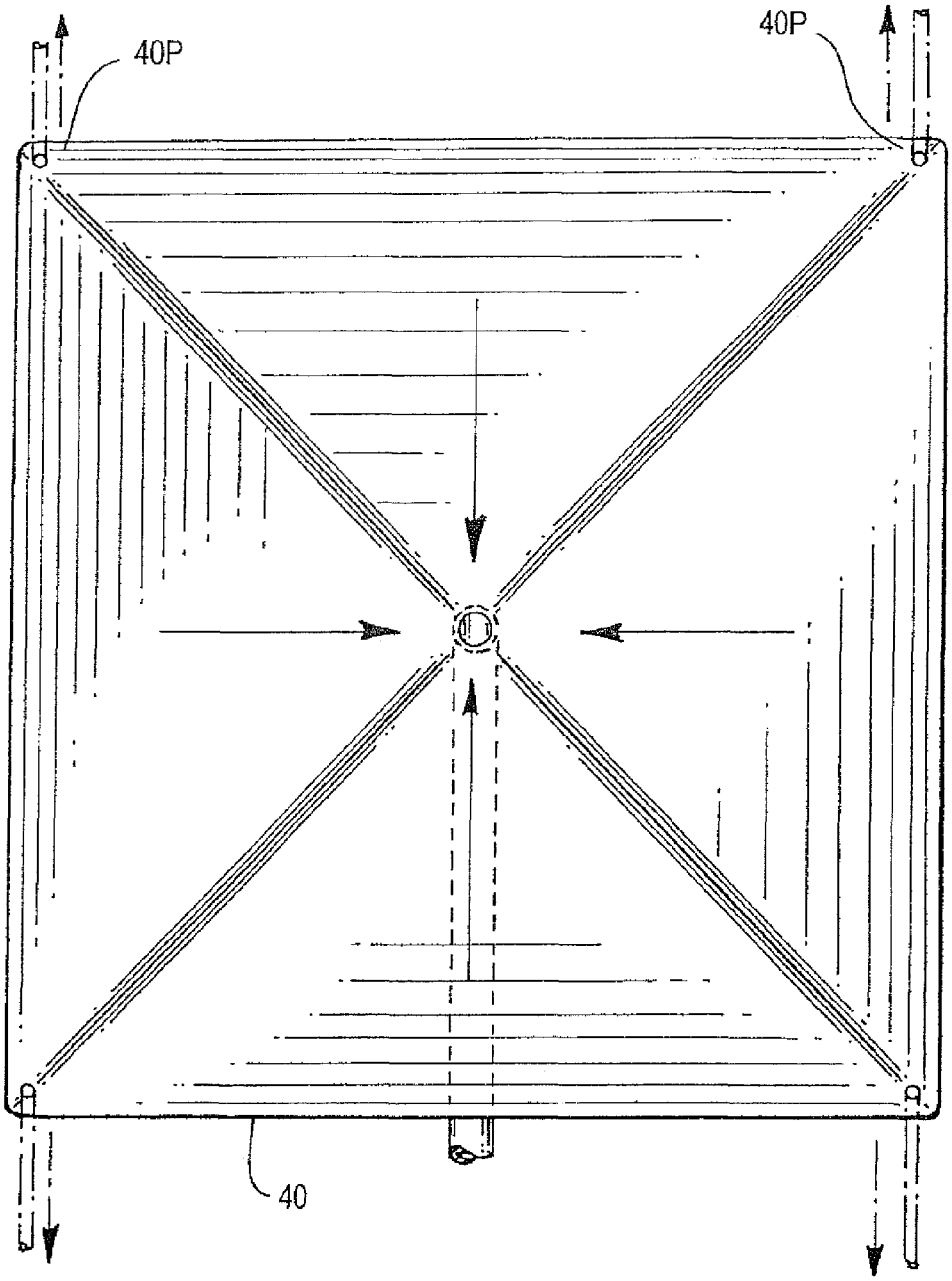
Figure 11:
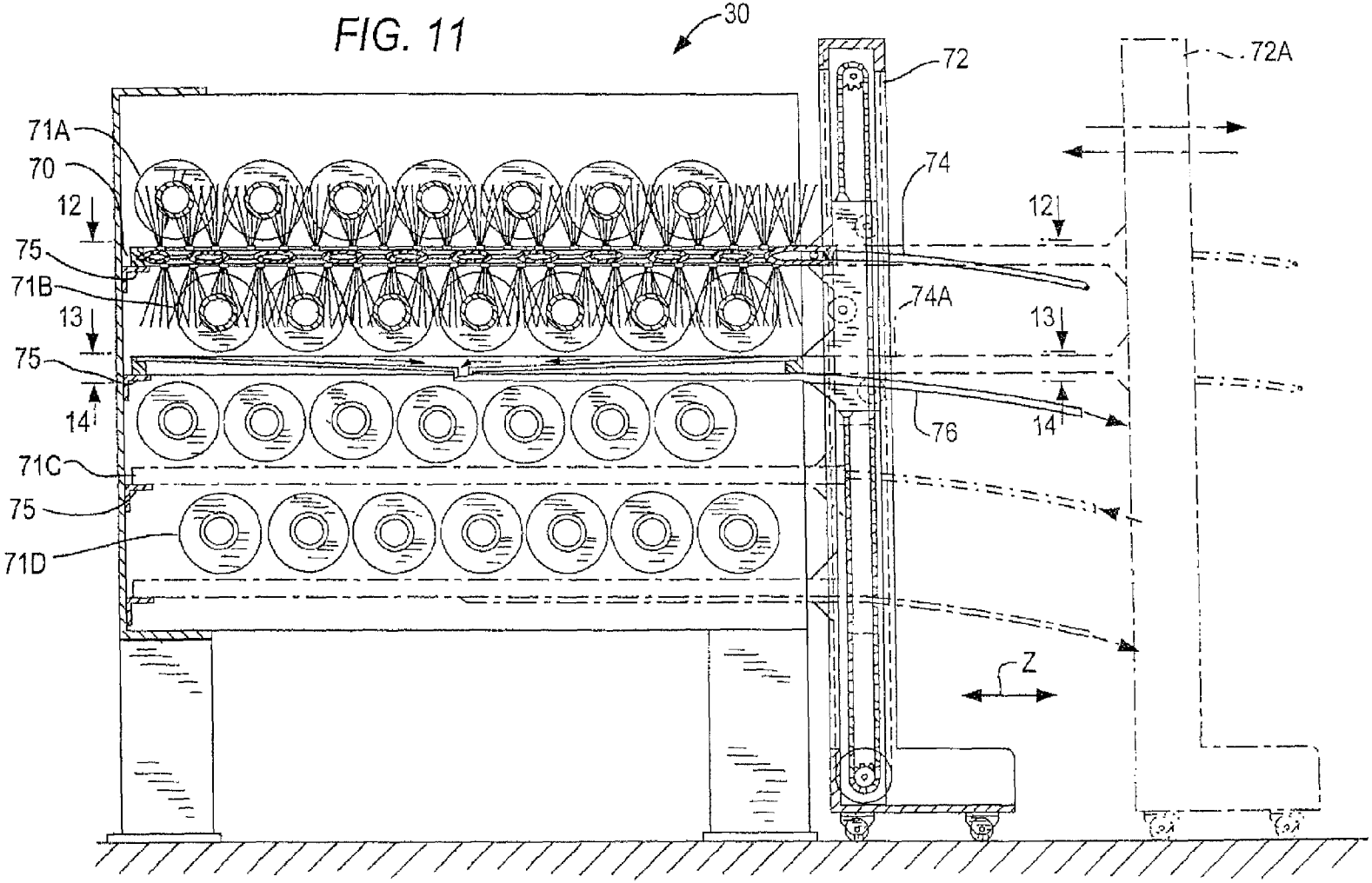
Figure 12:
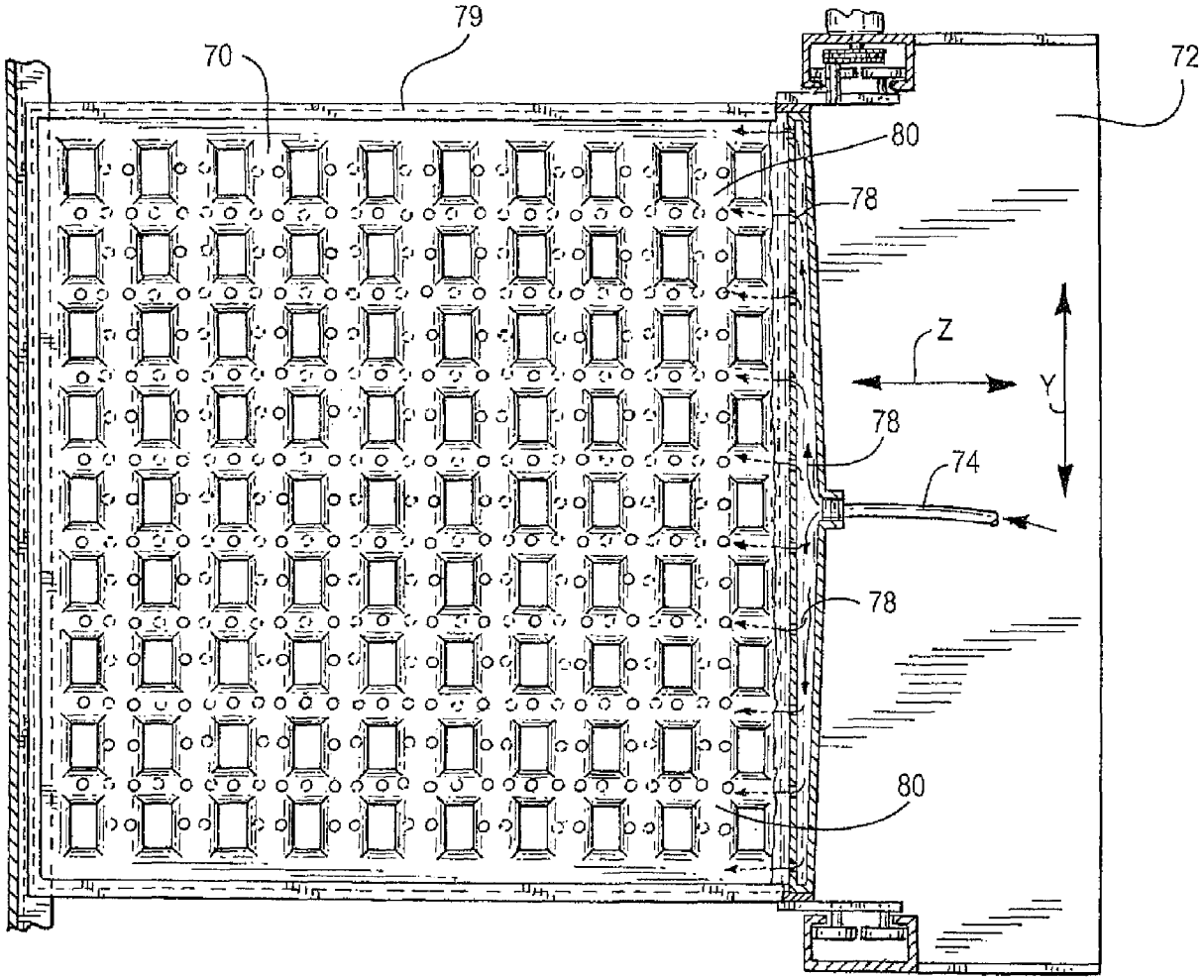
Figure 13:
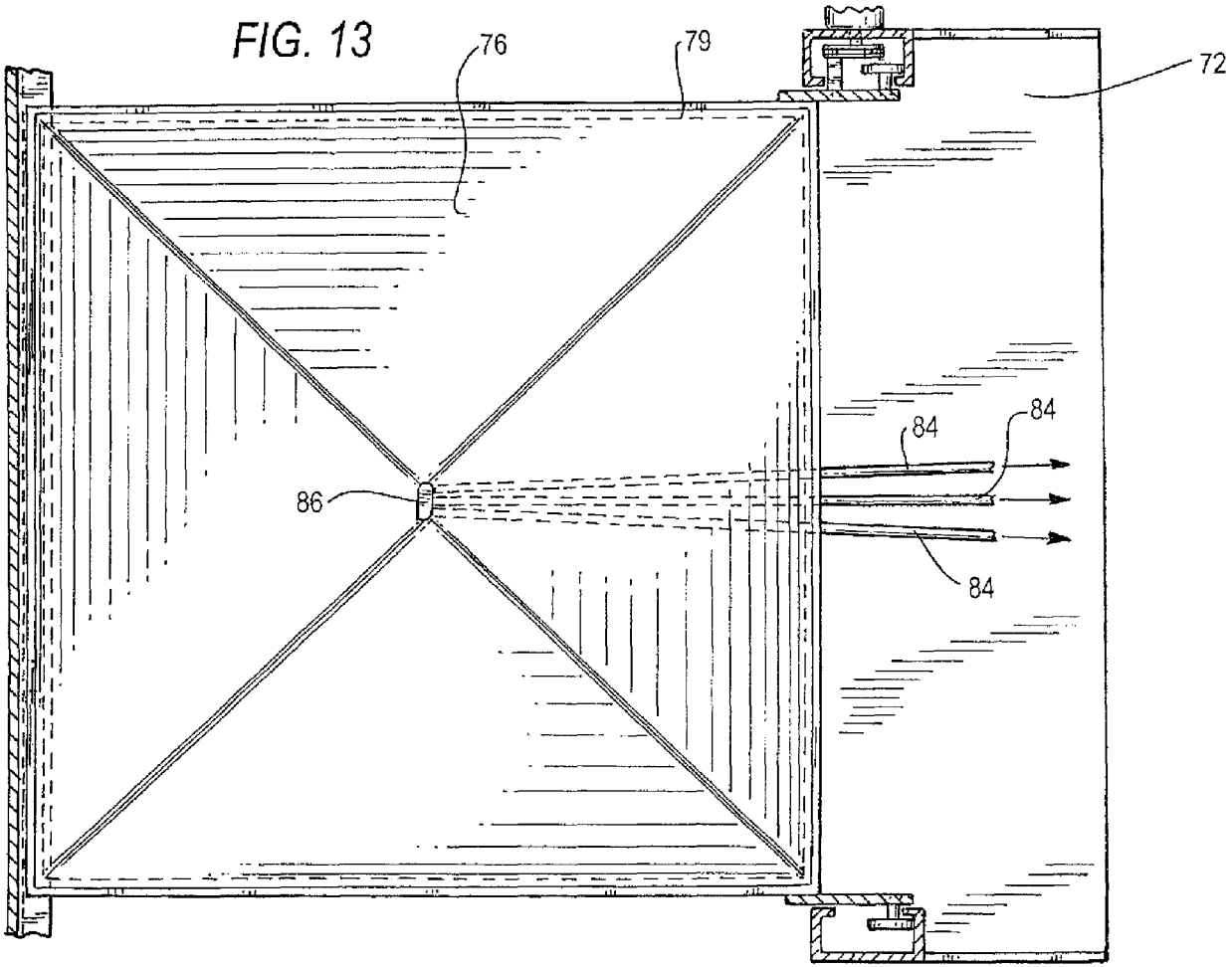
Figure 14:
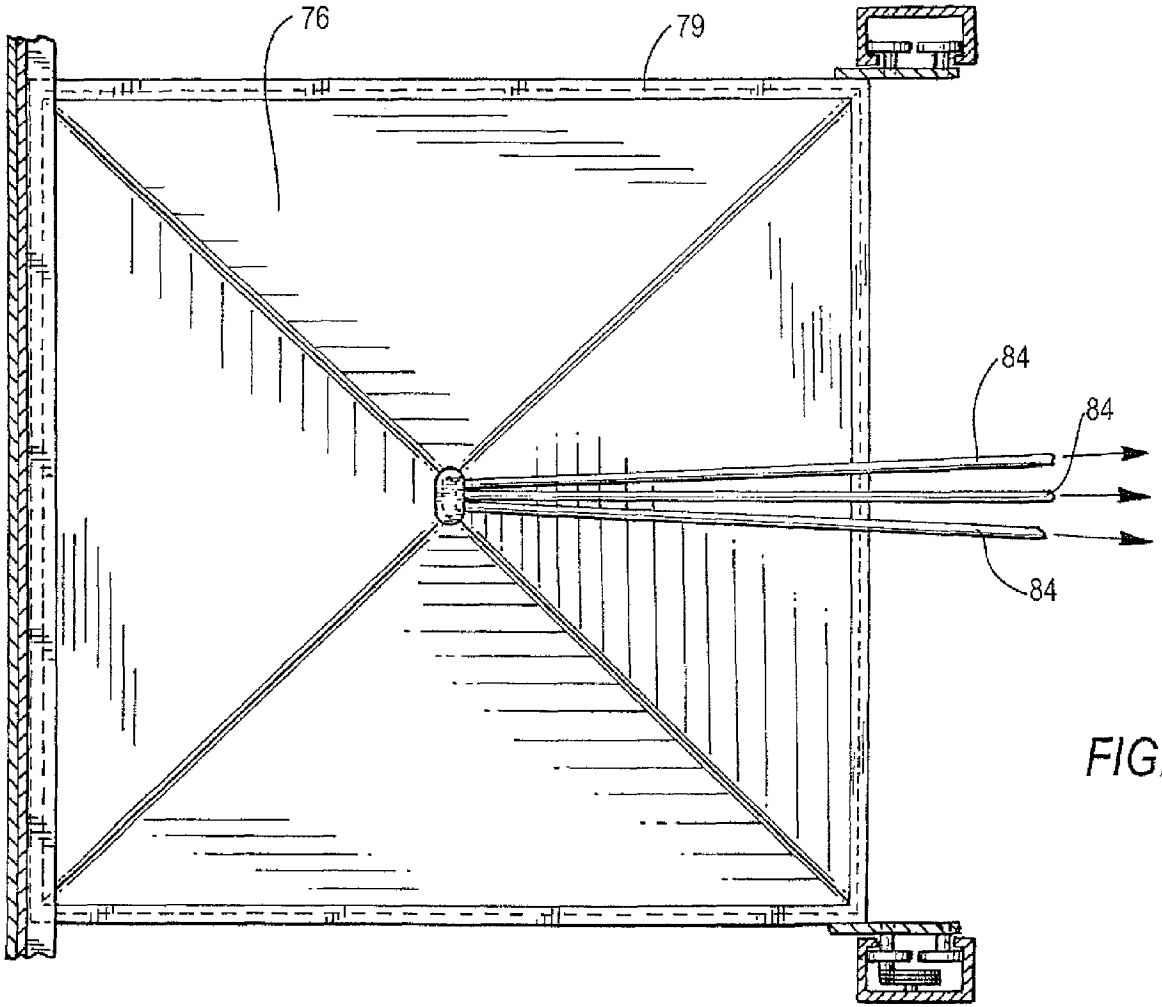

FIG. 9D is a top front perspective view of the nozzle spring of said nozzle in its extended state, FIG. 9E is a view similar to FIG. 9D showing the nozzle spring in its retracted state, FIG. 10 is a plan view of the collection pad, FIG. 11 is an elevation view in section similar to FIG. 5 showing a second embodiment of the new cleaning apparatus, FIG. 12 is a schematic top plan view of the spray pad associated with the cleaning apparatus of FIG. 11, FIG. 13 is a top plan view of the collection pad associated with either cleaning apparatus of FIG. 4 or 11, and FIG. 14 is a bottom plan view of the collection pad of FIG. 13.

VI. DETAILED DESCRIPTION OF THE PREFERRED EMBODIMENT

The present invention is a method and apparatus for cleaning corrosive material, dirt and/or other material accumulated on the outer surfaces of ACHE heat exchanger tubes and accumulated particularly between and about the heat exchanger tube fins. FIGS. 1-3 illustrate a conventional ACHE 10 including a header or manifold 12, tubesheet 14, heat exchange tubes 16 within the outer surfaces 18, inlet 20 and outlet 22.

As seen in FIGS. 1-3 a conventional ACHE has heat exchange tubes situated in rows 24 comprising a tube bundle 26. Cleaning the outer surfaces and fins of these tubes is extremely difficult because most rows of tubes are beneath or hidden by other rows, and because many tubes are packed in a relatively compact bundles for design and space reasons. Furthermore, the fins are necessarily thin for heat exchange design reasons and are susceptible to damage if impacted by cleaning equipment. The above problems are multiplied when the ACHEs are in a desert or dusty environment as is the case with applicant's many gas and petroleum processing plants in Saudi Arabia.

FIG. 4 shows in a top plan view a general layout of a ACHE 30 with the new tube cleaning apparatus 37. FIGS. 5 and 6 show further structural details of tube cleaning apparatus 37 with a heat exchanger 30, its header 32, inlet 33, and a bundle 34 of heat exchange tubes arranged in rows, namely top row of tubes 34A, second row down of tubes 34B, next row below that 34C, etc. Shown schematically are thin fins 35 on the external surfaces of the heat exchanger tubes.

As seen in FIGS. 5 and 6 the cleaning apparatus 37 comprises: (a) a source of cleaning fluid in the form of a spray mat 38 that has the form of an inflatable sheet having some similarity to an air mattress, and (b) a sink 40 or collection sheet that collects the soiled cleaning fluid and directs it away from the tube bundle. Spray mat 38 is an inflatable laminate sheet which includes a substantial number of spray nozzles 38N distributed on its upper and lower surfaces. Interspersed between spray nozzles 38N are a plurality of drain holes 38D through which cleaning fluid particularly soiled cleaning fluid dripping down onto spray mat 38, can pass through the mat and onto the collection sheet or sink 40 below. Spray mat 38 has a similar array of spray nozzles 38N on its lower side which direct fluid downward to heat exchange tubes 34B of the second row, while the nozzles on the top surface spray direct cleaning fluid onto the bottom surfaces of heat exchange tubes in the top row 34A of the tube bundle.

As seen in FIG. 6 (and generally similarly in FIG. 12), cleaning fluid is applied from a high pressure source (not shown) via a flexible tube 41A to an inlet 41B in a side region of spray mat 38. This fluid flows through channels in the interior of spray mat 38 to the above-mentioned spray nozzles 38N. The soiled cleaning fluid that drips downward from "cleaned" row 34A tubes onto the top surface of spray mat 38, drips through drain holes 38D, then drips onto collection mat 40 which is generally concavely curved or inclined downward in its center, to drain hole 40A and drain duct 40B which discharges the soiled fluid away from the tube bundle.

An object of the present invention is to provide an apparatus and method that can deliver cleaning fluid sprayed from above and below the rows of heat exchanger tubes, in a way that has not previously been possible. As opposed to prior art methods which spray only from the top downward and/or from the bottom upward, and which fails to adequately impact onto the many tubes in the bundle inward of the exposed outer rows, the new spray mat is thin enough to be pulled into the space between two rows and to be closely adjacent substantially all of the exposed upper and lower surfaces of said heat exchange tubes.

As seen in FIGS. 4 and 5, spray mat 38 can be rolled onto roller 38R which is carried by a transport mechanism 42. When properly positioned by transport mechanism 42, spray mat 38 is pulled off its roller 38R into the space between adjacent rows, which may be between top row 34A and second row 34B (as shown in FIG. 5), or may be between second row 34B and third row 34C, or may be above first row 34A, etc. Spray mat 38 is pulled into such location by a pulling element 38P which may take many alternative forms. Mat 38 is subsequently withdrawn by being rolled back onto roller 38R by a roller mechanism on transport mechanism 42.

FIG. 5 shows the transport mechanism 42 positioned along the side edge of the tube bundles 34. This transport mechanism can be moved by drive means 42D in the direction of the arrow X (see FIG. 4) towards the far end of the tube bundle or positions in between. Also transport mechanism 42 can be moved in the vertical direction of arrow Y (see FIGS. 4 and 5) to re-position spray mat 38 at appropriate elevations to be inserted between selected rows 34A, 34B, 34C, etc. of heat exchange tubes of the tube bundle 34. FIG. 5 shows spray mat 38 positioned between rows 34A and 34B of heat exchanger tubes, and cooperating collection sheet 40 positioned below row 34D of tubes, with its drain tube 40B extending out of the bottom of collection sheet 40. Also in FIG. 5 is seen roller 38R for withdrawing and rolling up spray mat 38, and roller 40R for withdrawing and rolling up collection sheet 40. These two rollers are mounted on transport apparatus 42 which, as discussed before, can move vertically in the Y direction or transversely in the X direction.

FIGS. 6, 7, and 8 illustrate the structure of the spray mat 38 which comprises (a) upper sheet 50 and lower sheet 51 sealed together in selected areas, and not sealed and other areas to define fluid flow ducts 52, (b) a multiplicity of spray nozzle openings 53 on top and bottom surfaces where each spray opening communicates with a fluid flow duct, and (c) a spray nozzle 60 associated with each opening 53. The many ducts 52 are fed cleaning fluid by one or more inlets 41B as seen in FIG. 6. An alternate method of providing fluid to the spray nozzles would be to have small tubes distributed over the top or bottom surface of the spray mat, instead of having ducts formed by a pattern of sealed areas between the top and bottom sheets forming the mat.

Spray mat 38 also has a plurality of through holes 38D which serve as the previously described drain holes for fluid to drip down onto and through spray mat 38, and thence to be collected by collection sheet 40 below.

FIGS. 9A-9E illustrate one of the many spray nozzles 60 in spray mat 38. Each spray nozzle is formed by a generally conical piece of flexible material 61 having a plurality of openings 62 which communicate with the above-mentioned fluid channels 52.

In this preferred embodiment it is desired that the nozzles have a normally compressed state as seen in FIG. 9C, and be extendible axially to their extended state as seen in FIG. 9B. Accordingly, the spray mat, when the nozzles are compressed, can be as thin as possible for negotiating it between tight spaces between rows of heat exchange tubes. Then, when cleaning fluid is directed through channels 52 to these nozzles, the pressure of the cleaning fluid will cause the nozzles to pop out into their extended configuration as seen in FIGS. 9A and 9B. Within the flexible material 61 of each nozzle is a coil spring 64, incorporated into the flexible material 61 of the nozzle, where the spring has a normal relaxed and retracted state as seen in FIGS. 9C and 9E. The spring will bias the nozzle to remain in the closed retracted state at all times including during movement of spray mat into or out of spaces between heat exchange tubes and when it is rolled onto roller 38R. However, when spray mat 38 is extended into the space between upper and lower rows of tubes, and when cleaning fluid under pressure is directed through channels 52, the fluid will force the nozzles to pop out into their extended and generally conical shape, so that the holes 62 in the nozzles' conical surfaces, facing many different directions will direct cleaning fluid in a great multiplicity of directions and will clean the maximum area of the heat exchange tubes and the fins thereof.

Also seen in FIGS. 7 and 8 are drain holes 38D extending between top and bottom sheets 50, 51 of the spray mat 38. These drain holes extend through the mat in areas that are otherwise seal together and thus do not interfere with the joined areas that define the fluid flow ducts.

FIGS. 10-14 illustrate in more detail the collection sheet 40 which is constructed to have or take a generally concave shape or inclined downward which descends in a central area to its drain hole 40 and drain duct 40A for disposing of soiled cleaning fluid that has dripped onto the top surface of collection sheet 40. At corners or other edges of collection sheet 40 are apertures 40P or other means for engaging and pulling collection sheet 40 into the space between, above or below rows of heat exchange tubes and then back out and on onto roller 40R. Collection sheet 40 may be constructed to have a memory to take the above-mentioned concave or inclined shape after it is expanded, or it may have elastic members which form the mat into the above-mentioned shape after it is positioned in its fluid collection capacity.

As seen in these illustrations of the preferred embodiment, the new ACHE tube cleaning apparatus can be maneuvered into very close quarters between rows of heat exchange tubes in a bundle, which allows cleaning from nozzles positioned very close to the areas to be cleaned, that could never be done before. The results and benefits of this new invention are seen to a greatly enhance heat exchanger operation by rendering the heat exchange apparatus more efficient, by reducing downtime during the cleaning process, by reducing damage to heat exchangers and/or by providing all of the above at a greatly reduced cost as compared to prior art.

FIGS. 11, 12 and 13 illustrate a second embodiment of the present invention, whereby spray mat 30 that can be rolled up in FIG. 5, is replaced by spray mat 70 that remains generally planar in FIG. 11 and cooperates with heat exchanger 69. This alternate spray mat 70 is supported by transporter 72 which moves in the Z direction to withdraw mat 70 from between row 71A and row 71B of heat exchange tubes. Subsequently, transporter 72 can lower and insert mat 70 between row 71B and 71C of heat exchange tubes. The alternate spray mat 70 may have a peripheral or other frame 79 to maintain its shape, and may utilize supportive guide elements, such as brackets or shelves 75 shown in FIGS. 11-13, While this second embodiment arrangement requires more floor space for transport 72 to move away from heat exchanger 69, it enables a simple fluid connection 74 to the fluid ducts in mat 70 which is no longer being rolled up, and enables a simple translation of mat 70 in and out in the Z direction with omission of the pulling means 38P and the rollers in the embodiment of FIG. 5.

FIG. 11 further illustrates how transporter 72 in its laterally displaced position indicated in dashed line 72A, can lower spray mat 74 to its partially descended elevation indicated by reference number 74A and insert spray mat 74 between row 71B and row 71C of heat exchange tubes.

With this arrangement a sink or collection sheet 76 can be similarly supported and inserted between rows of heat exchange tubes, or such sink or collection sheet 76 can simply be positioned beneath the lowest row of heat exchange tubes, as in FIG. 5, and removed at the conclusion of cleaning all the rows above FIG. 12 is a schematic top plan view of the spray mat 70 indicated by "12" in FIG. 11, showing the connection of spray mat 70 to transporter 72, and showing the further fluid connection 74 to cleaning fluid that flows as indicated by arrows 78 into fluid flow ducts 80 distributed throughout mat 70.

FIG. 13 is a schematic top plan view taken at level "13" in FIG. 11 showing collection mat or sink 76 coupled to transporter 72. As stated above, sink 76 could be inserted only at the lowest elevation and kept there until the cleaning between all the rows of heat exchange tubes is completed. FIG. 13 further shows drain tubes 84 leading soiled fluid from central drain hole 86 in sink 76.

FIG. 14 merely shows a bottom plan view of the collection sheet or sink 76 of FIG. 13.

The spray mats 38, 70 and collection sheets 40, 76 of said above referenced first and second embodiments respectively, may be made of various fabrics including nylon and other plastic. The nozzles are can be made of various similar flexible materials, and the coil springs within the nozzles may be made of plastic or metal, preferably materials not susceptible to corrosion or fatigue and obviously selected to have adequate strengths, memory and long life. The transport mechanism including the rollers and pulling means for directing the spray sheet and collection sheet to their desired positions would be made of from typical commercial materials and apparatus.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the claims.

The invention claimed is:

1. An apparatus, operable with a source of cleaning fluid under pressure, for cleaning external surfaces of heat exchange tubes of an air cooled heat exchanger which tubes are situated in generally horizontal rows that are vertically separated from each other, thus defining a generally horizontal zone between each two adjacent rows, which space has a height defined by the distance between each of said two adjacent rows, comprising:

a. a spray mat having:

i. top and bottom fluid impermeable sheets sealed at their mutual peripheral edges defining at least one chamber between said sheets, with at least one fluid inlet into said chamber for receiving a flow of said cleaning fluid under pressure, ii. a plurality of laterally spaced apart apertures in at least one of said top and bottom sheets, said apertures being in fluid communication with said at least one chamber, and iii. a spray nozzle coupled to each of said apertures for outward spraying of cleaning fluid received from said chamber, and b. a positioning mechanism for moving said spray mat transversely into one of said zones between two adjacent rows of said heat exchange tubes, where said cleaning fluid can be sprayed onto the external surfaces of said heat exchanger tubes in said zone, and for moving said spray mat out of said zone.

2. The apparatus according to claim 1 which has said plurality of spaced apart apertures in both said top and bottom sheets.

3. The apparatus according to claim 1 where said top and bottom sheets have mutually facing inside surfaces that are sealed together at predetermined locations to define said at least one chamber and a plurality of fluid flow channels communicating said inlet with said plurality of outlet apertures.

4. The apparatus according to claim 2 where said top and bottom sheets are formed of plastic and are heat sealed together at their peripheral edges and at other areas for defining said flow channels within said chamber between said sheets.

5. The apparatus according to claim 1 where said positioning mechanism is adapted to move said spray mat to selected elevations for positioning said spray mat into different ones of said zones.

6. The apparatus according to claim 5 where said positioning mechanism includes a roller onto which said spray mat is rolled and stored until said spray mat is unrolled and inserted into one of said zones.

7. The apparatus according to claim 1 where said spray mat has a leading edge for insertion into one of said zones and an opposite trailing edge, and said positioning mechanism engages and pulls said leading edge for said insertion.

8. The apparatus according to claim 1 further comprising a hose connecting said source of cleaning fluid to said inlet of said spray mat.

9. The apparatus according to claim 1 where each of said spray nozzles has an outer surface and has a retracted position where its outer surface is generally close to the external surface of said top or bottom sheet where it is situated, and has an extended position extending outwardly from the plane of said surface, further comprising a spring biasing said spray nozzle to its retracted position, said nozzle being pushed to its extended position when cleaning fluid under pressure is flowed from said source of cleaning fluid through said chamber to said nozzle.

10. The apparatus according to claim 9 where each of said springs has force F, and said cleaning fluid exerts a pressure greater than force F, which thereby pushes said spray nozzle to its extended position when said cleaning fluid is flossing under pressure to said spray nozzles.

11. The apparatus according to claim 1 further comprising a collection sheet having leading and trailing edges and a generally central area with a drain aperture therein, said positioning mechanism further including coupling for inserting said collection sheet into one of said zones below a zone where said spray mat has been inserted, and where said collection sheet receives cleaning fluid dripping down from said spray met and from external services of heat exchange tubes which received cleaning fluid from said spray mat, said cleaning fluid being discharged from said drain aperture in said collection sheet.

12. The apparatus according to claim 1 where said positioning mechanism further comprises a spring biasing said roller to a rotated position in which said spray met his rolled onto said roller.

13. The apparatus according to claim 1 where each of said spray nozzles distributes cleaning fluid in a flow pattern substantially greater than the inlet diameter of said spray nozzle.

14. The apparatus according to claim 1 further comprising a hose extending from said drainage aperture of said collection sheet to a discharge area.

15. The apparatus according to claim 2 where the height of said spray mat with said spray nozzles in their extended state is less than the height of said zone between two adjacent rows of said heat exchange tubes.

16. The apparatus according to claim 1 where said spray mat further comprises a plurality of spaced apart apertures extending completely through said spray mat in the top to bottom direction, these apertures defining passageways not in fluid communication with said chamber.

17. The apparatus according to claim 3 where said spray mat further comprises a plurality of spaced apart apertures extending completely through said spray mat in the top to bottom direction, these apertures defining passageways not in fluid communication with said chamber.

* * * * *